US011018458B2

(12) United States Patent
Pan

(10) Patent No.: US 11,018,458 B2
(45) Date of Patent: May 25, 2021

(54) ELECTRICAL CONNECTOR WITH AN ELECTROMAGNETIC SHIELDING MECHANISM

(71) Applicant: Tyco Electronics (Shanghai) Co. Ltd., Shanghai (CN)

(72) Inventor: Biao Pan, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/739,877

(22) Filed: Jan. 10, 2020

(65) Prior Publication Data

US 2020/0153171 A1 May 14, 2020

Related U.S. Application Data

(63) Continuation of application No. PCT/EP2018/068161, filed on Jul. 5, 2018.

(30) Foreign Application Priority Data

Jul. 13, 2017 (CN) ..... 201720852451.7

(51) Int. Cl.

| | |
|---|---|
| ***H01R 13/648*** | (2006.01) |
| ***H01R 13/6594*** | (2011.01) |
| ***H01R 12/70*** | (2011.01) |
| ***H01R 13/207*** | (2006.01) |
| ***H01R 13/52*** | (2006.01) |
| ***H01R 13/74*** | (2006.01) |

(52) U.S. Cl.

CPC ..... *H01R 13/6594* (2013.01); *H01R 12/707* (2013.01); *H01R 13/207* (2013.01); *H01R 13/5202* (2013.01); *H01R 13/746* (2013.01)

(58) Field of Classification Search

CPC ..... H01R 2103/00; H01R 12/57; H01R 4/64; H01R 13/65802; H01R 4/646; H01R 23/688; H01R 23/6873; H01R 13/635; H01R 13/5219; H01R 13/5202; H01R 13/5208; H01R 13/74; H01R 33/00

USPC ..... 439/63, 83, 92, 95, 98, 101, 108, 581, 439/582, 607.35, 607.36, 607.4, 947, 271, 439/272, 275, 548, 556, 559

See application file for complete search history.

(56) References Cited

U.S. PATENT DOCUMENTS 3,678,444 A * 7/1972 Stevens ..... H01R 24/52 439/551

3,920,304 A * 11/1975 Bromberg ..... H01R 13/74 439/274

(Continued)

FOREIGN PATENT DOCUMENTS

WO 9802937 A1 1/1998

OTHER PUBLICATIONS

PCT Notification, International Search Report, Written Opinion of the International Searching Authority, International App. No. PCT/EP2018/068161, dated Aug. 22, 2018, 16 pages.

*Primary Examiner* — Thanh Tam T Le

(74) *Attorney, Agent, or Firm* — Barley Snyder

(57) ABSTRACT

A connector includes a housing having a thread post at a first end and a thread head at a second end opposite to the first end, an insulation body received in the housing, a terminal disposed in the insulation body and received in the housing, and an electromagnetic shielding mechanism. The electromagnetic shielding mechanism is welded on a surface of the thread head adjacent to the thread post.

15 Claims, 4 Drawing Sheets

(56) References Cited

U.S. PATENT DOCUMENTS 4,653,835 A * 3/1987 Schulte ..... H01R 13/743 439/277
4,795,352 A * 1/1989 Capp ..... H01R 24/50 439/63
5,062,811 A * 11/1991 Hackman ..... H01R 24/50 439/581
5,108,300 A * 4/1992 Weber ..... H01R 13/7033 439/188
5,167,536 A * 12/1992 Wang ..... H01R 13/7195 333/185
5,326,280 A * 7/1994 Briones ..... H01R 13/7195 439/581
5,417,591 A * 5/1995 Demmler ..... H01R 13/7197 439/620.14
5,641,294 A * 6/1997 Beard ..... H01R 13/746 439/247
6,139,344 A * 10/2000 Wang ..... H01R 13/2421 200/51.1
6,428,354 B1 * 8/2002 Meyer ..... H01R 13/746 411/405
6,809,255 B1 * 10/2004 Chun ..... H01H 50/10 174/382
7,351,074 B2 * 4/2008 Ju ..... H01R 12/57 361/230
7,427,215 B2 * 9/2008 Heckmann ..... H01R 13/03 439/607.41
7,632,145 B1 * 12/2009 Lin ..... H01R 13/6597 439/607.32
7,736,159 B1 * 6/2010 Effinger, III ..... H01R 24/86 439/108
7,749,020 B1 * 7/2010 Chang ..... H01R 4/027 439/567
8,628,340 B2 * 1/2014 Chiu ..... H01R 13/6594 439/83
8,636,522 B2 * 1/2014 Sykes ..... H01R 9/0515 439/63
8,790,136 B2 * 7/2014 Duesterhoeft ..... H01R 13/6583 439/607.35
8,979,580 B2 * 3/2015 Bitzer ..... H02K 5/10 439/560
9,184,544 B2 * 11/2015 Sasano ..... H01R 13/6595
2009/0137133 A1 5/2009 Gou
2010/0099300 A1 4/2010 Hsieh
2010/0124854 A1 5/2010 Liu
2010/0190375 A1 7/2010 Rohde

* cited by examiner

ELECTRICAL CONNECTOR WITH AN ELECTROMAGNETIC SHIELDING MECHANISM

CROSS-REFERENCE TO RELATED APPLICATIONS

This application is a continuation of PCT International Application No. PCT/EP2018/068161, filed on Jul. 5, 2018, which claims priority under 35 U.S.C. § 119 to Chinese Patent Application No. 201720852451.7, filed on Jul. 13, 2017.

FIELD OF THE INVENTION

The present invention relates to an electrical connector and, more particularly, to a round connector.

BACKGROUND

A round connector adapted to be mounted on an installation panel (for example, a shell) of an electrical equipment generally comprises a housing, an insulation body received in the housing, and a plurality of terminals provided in the insulation body.

For this round connector to be mounted on an installation panel of an electrical equipment, it is difficult to add an electromagnetic shielding structure to the round connector due to space constraints. However, in some applications, the round connector is required to have electromagnetic shielding. Therefore, it is necessary to develop an electromagnetic shielding structure which does not increase the size of the round connector and provides effective electromagnetic shielding effect for the round connector.

SUMMARY

A connector includes a housing having a thread post at a first end and a thread head at a second end opposite to the first end, an insulation body received in the housing, a terminal disposed in the insulation body and received in the housing, and an electromagnetic shielding mechanism. The electromagnetic shielding mechanism is welded on a surface of the thread head adjacent to the thread post.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
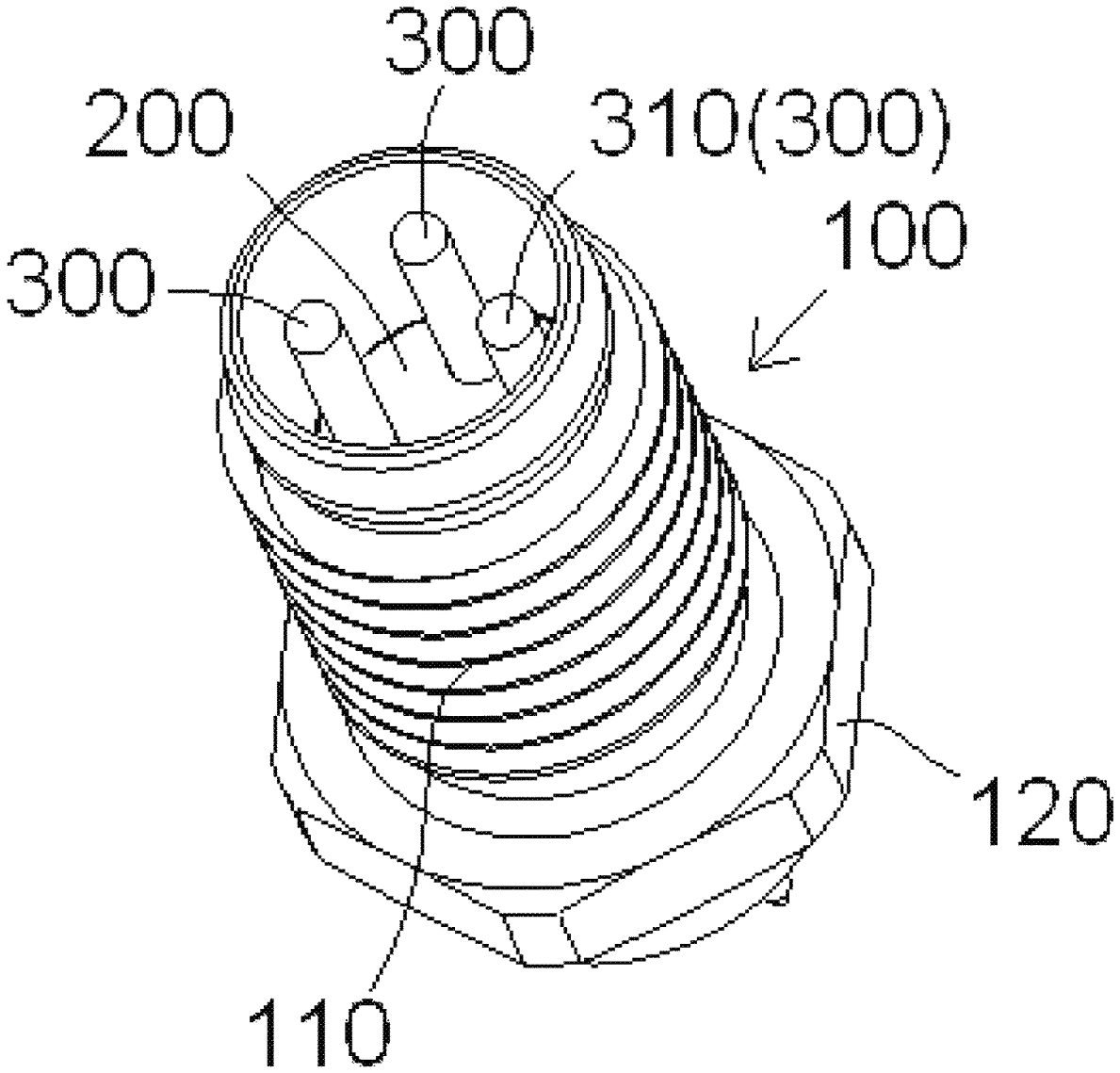
FIG. 1 is a perspective view of an electrical connector according to an embodiment without an electromagnetic shielding mechanism.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiment set forth herein; rather, these embodiments are provided so that the present disclosure will convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
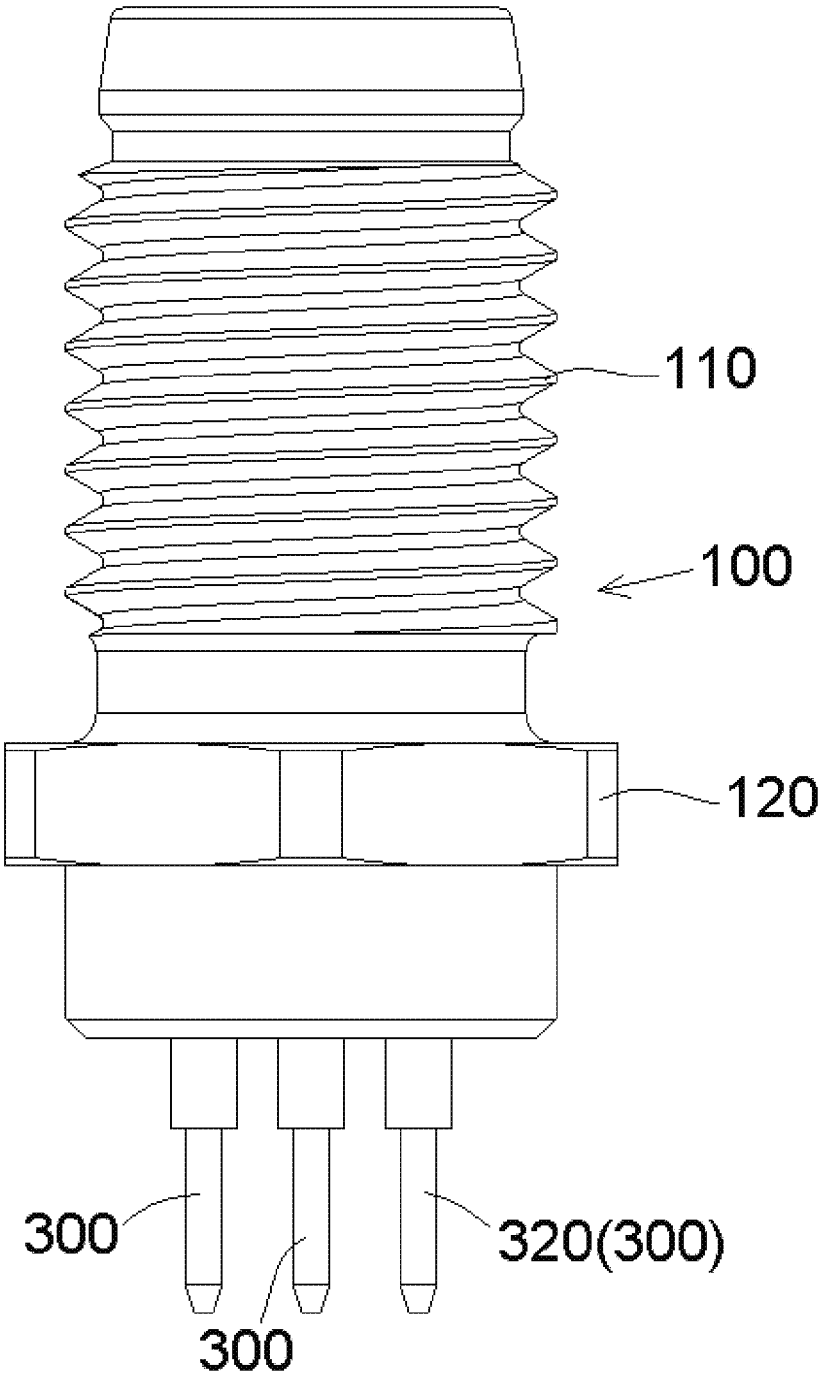
FIG. 2 is a side view of the electrical connector of FIG. 1.

An electrical connector, as shown in FIGS. 1 and 2, comprises a housing 100, an insulation body 200, and a terminal 300. The housing 100 is generally made of metal. The housing 100 has a thread post 110 at a first end and a thread head 120 at a second end opposite to the first end. The insulation body 200 is received in the housing 100. The terminal 300 is provided in the insulation body 200 and received in the housing 100.

Figure 3:
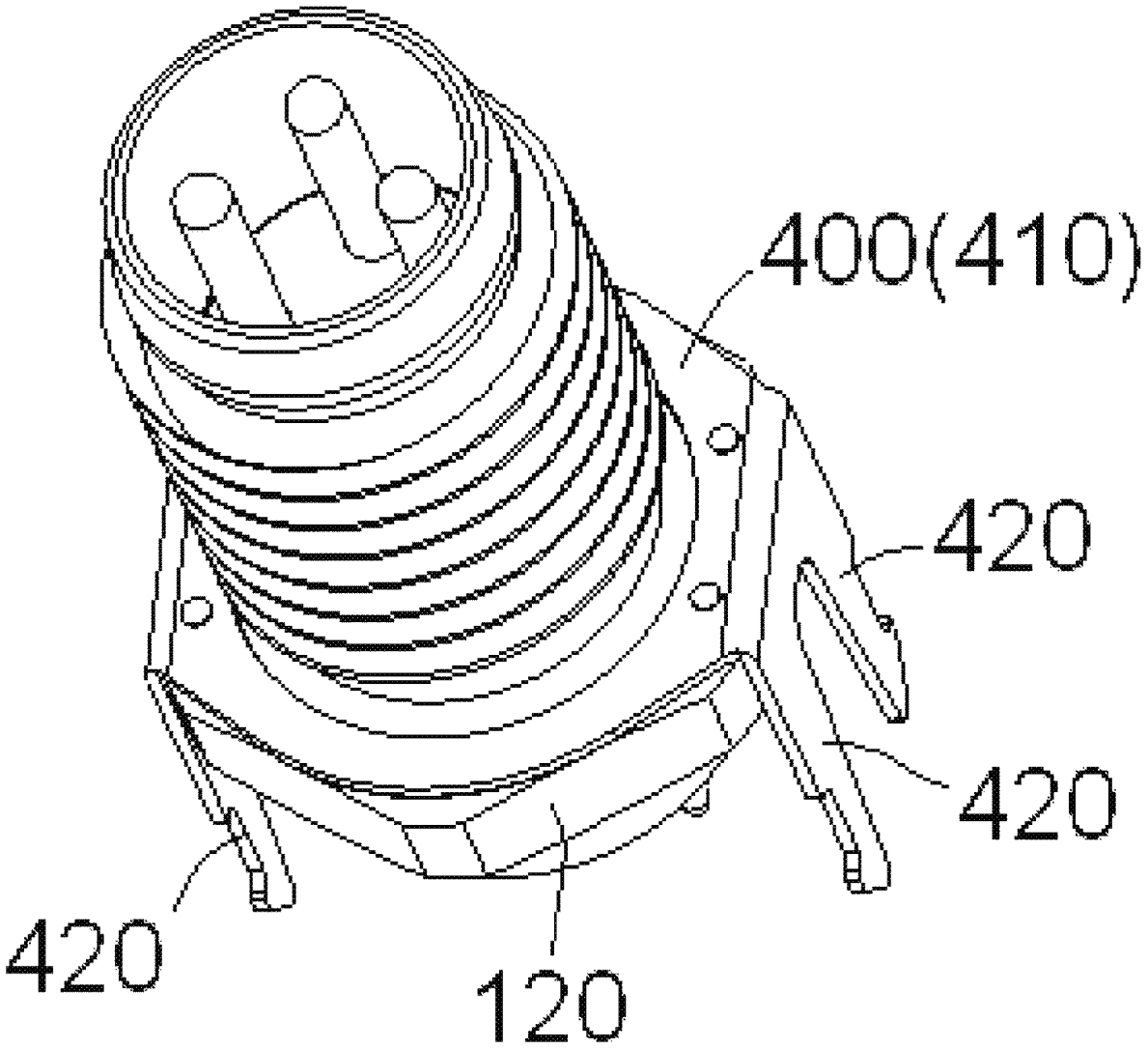
FIG. 3 is a perspective view of the electrical connector with the electromagnetic shielding mechanism.
Figure 4:
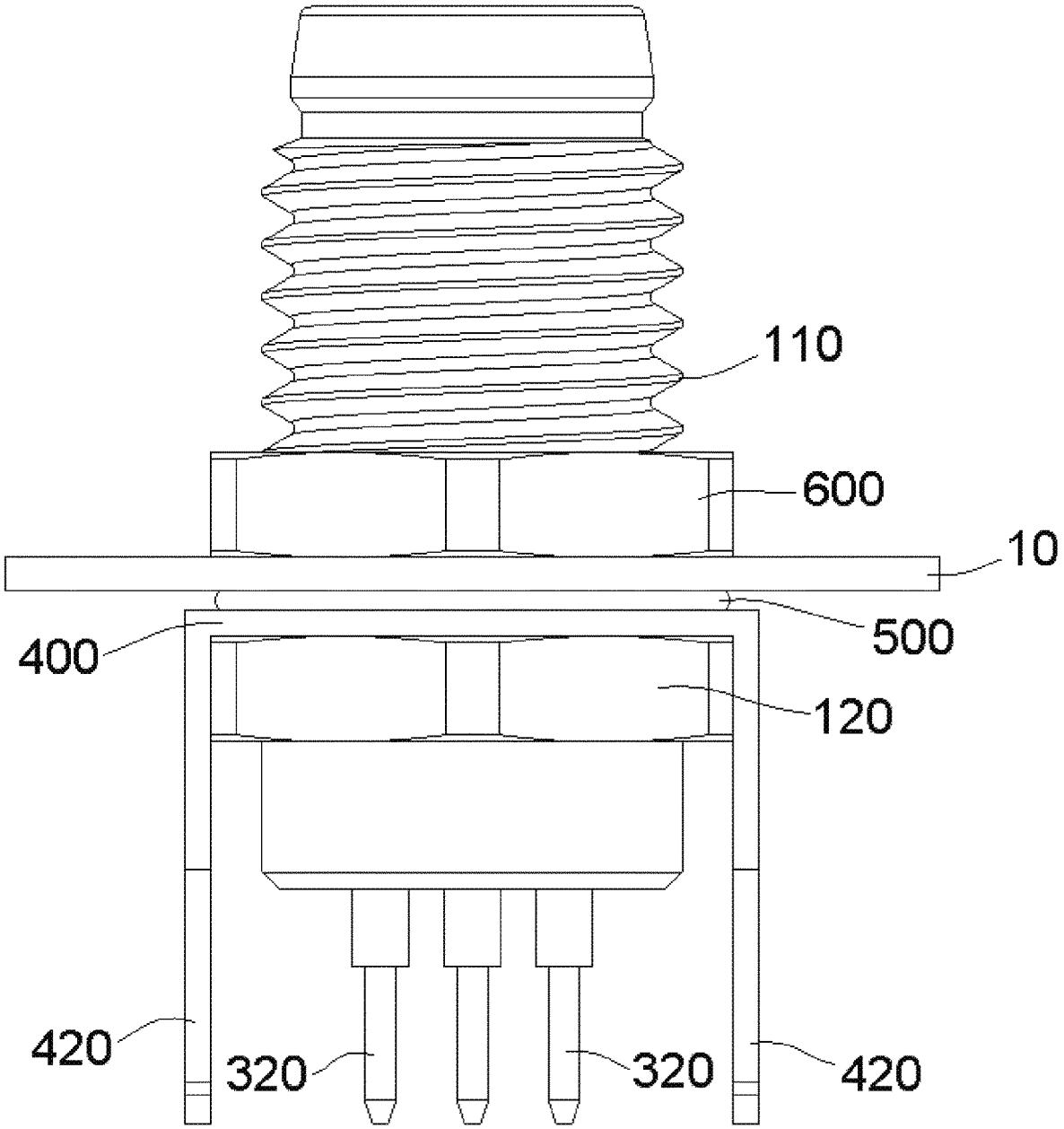
FIG. 4 is a side view of the electrical connector with the electromagnetic shielding mechanism of FIG. 3 secured to an installation panel.

The electrical connector, as shown in FIGS. 3 and 4, further comprises an electromagnetic shielding mechanism 400. The electromagnetic shielding mechanism 400 is welded on a surface of the thread head 120 adjacent to the thread post 110. The connector is shown secured to an installation panel 10 in FIG. 4.

As shown in FIGS. 3-4, in an embodiment, the connector further comprises a nut 600 adapted to be screwed onto the thread post 110. The thread post 110 extends through an installation hole formed in an installation panel 10. The connector is secured on the installation panel 10 by tightening the nut 600 on the thread post 110.

As shown in FIGS. 3-4, in an embodiment, the connector further comprises a sealing ring 500 adapted to be sleeved onto the thread post 110. The sealing ring 500 is adapted to be compressed between the electromagnetic shielding mechanism 400 and the installation panel 10, so as to seal an interface of the connector and the installation panel 10. When the connector is secured on the installation panel 10, the nut 600 is located at a first side of the installation panel 10, while the thread head 120, the electromagnetic shielding mechanism 400 and the sealing ring 500 are located at a second side of the installation panel 10 opposite to the first side.

The electromagnetic shielding mechanism 400, as shown in FIGS. 3 and 4, includes a plate-shaped part 410 extending horizontally and a plurality of welding feet 420 extending vertically from a periphery of the plate-shaped part 410 in an axial direction of the connector. The plate-shaped part 410 of the electromagnetic shielding mechanism 400 is welded to the surface of the thread head 120 adjacent to the thread post 110. In an embodiment, the plate-shaped part 410 of the electromagnetic shielding mechanism 400 is welded to the surface of the thread head 120 by spot welding. The plurality of welding feet 420 of the electromagnetic shielding mechanism 400 are adapted to be welded to a circuit board (not shown).

In the embodiment shown in FIGS. 3-4, the plate-shaped part 410 of the electromagnetic shielding mechanism 400 has a shape matching a shape of the thread head 120. The plurality of welding feet 420 of the electromagnetic shielding mechanism 400 abut against a side surface of the thread head 120.

The terminal 300, as shown in FIGS. 1, 2, and 4, includes a first end 310 at the first end of the housing 100 and a second end 320 at the second end of the housing 100. The first end 310 of the terminal 300 is adapted to electrically contact a mating connector. The second end 320 of the terminal 300 is welded onto the circuit board.

In the shown embodiment, the connector is a round connector with a cylindrical shape. The round connector is adapted to be mounted on a shell (also referred as an installation panel) of an electric equipment. The second end 320 of the terminal 300 and the plurality of welding feet 420 of the electromagnetic shielding mechanism 400 are welded to the circuit board provided in the shell of the electric equipment.

In the above embodiments, the electromagnetic shielding mechanism 400 is welded to the thread head 120 of the housing 100 of the connector. Thereby, the electromagnetic shielding mechanism 400 will not affect the size and installation of the connector, and the connector may be easily mounted. In addition, the electromagnetic shielding mechanism 400 does not affect the sealing ring 500, and it will not reduce the waterproof performance of the connector. In the above embodiments, there is no need to add any additional electromagnetic shielding structural for the connector except the electromagnetic shielding mechanism 400, thus reducing the cost of the connector and the difficulty of assembling and manufacturing the connector.

It should be appreciated for those skilled in this art that the above embodiments are intended to be illustrative, and not restrictive. For example, many modifications may be made to the above embodiments by those skilled in this art, and various features described in different embodiments may be freely combined with each other without conflicting in configuration or principle. Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A connector, comprising:

a housing having a thread post at a first end and a thread head at a second end opposite to the first end, the thread post extends through an installation hole in an installation panel;

an insulation body received in the housing;

a terminal disposed in the insulation body and received in the housing;

an electromagnetic shielding mechanism welded on a surface of the thread head adjacent to the thread post, the electromagnetic shielding mechanism has a plate-shaped part extending horizontally and a plurality of welding feet extending vertically from a periphery of the plate-shaped part beyond a side of the thread head opposite the surface, only the plurality of welding feet extend from the periphery of the plate-shaped part; and a sealing ring sleeved onto the thread post, the sealing ring is compressed between and abuts the electromagnetic shielding mechanism and the installation panel.

2. The connector of claim 1, further comprising a nut screwed onto the thread post.

3. The connector of claim 2, wherein the connector is secured on the installation panel by tightening the nut on the thread post.

4. The connector of claim 3, wherein the sealing ring seals an interface between the connector and the installation panel.

5. The connector of claim 4, wherein, when the connector is secured on the installation panel, the nut is disposed on a first side of the installation panel and the thread head, the electromagnetic shielding mechanism, and the sealing ring are disposed on a second side of the installation panel opposite to the first side.

6. The connector of claim 5, wherein the sealing ring is disposed entirely on the second side of the installation panel.

7. The connector of claim 1, wherein the plate-shaped part is welded to the surface of the thread head adjacent to the thread post.

8. The connector of claim 7, wherein the plurality of welding feet are welded to a circuit board.

9. The connector of claim 7, wherein the plate-shaped part is welded to the surface of the thread head by spot welding.

10. The connector of claim 7, wherein the plate-shaped part has a shape matching a shape of the thread head.

11. The connector of claim 7, wherein the plurality of welding feet abut a side surface of the thread head.

12. The connector of claim 1, wherein the terminal has a first end at the first end of the housing and a second end at the second end of the housing.

13. The connector of claim 12, wherein the first end of the terminal electrically contacts a mating connector and the second end of the terminal is welded onto a circuit board.

14. The connector of claim 1, wherein the connector is a round connector with a cylindrical shape.

15. The connector of claim 1, wherein at least two of the plurality of welding feet extend from each of a pair of opposite sides of the periphery of the plate-shaped part.

* * * * *